US008449345B2

(12) United States Patent
Yamada et al.

(10) Patent No.: US 8,449,345 B2
(45) Date of Patent: May 28, 2013

(54) BUILDING BLOCKS

(75) Inventors: Toshiaki Yamada, Osaka (JP); Masanori Kiba, Osaka (JP)

(73) Assignee: Tadatorayohsiten Co., Ltd., Osaka (JP)

( * ) Notice: Subject to any disclaimer, the term of this patent is extended or adjusted under 35 U.S.C. 154(b) by 2293 days.

(21) Appl. No.: 10/544,721

(22) PCT Filed: Feb. 6, 2004

(86) PCT No.: PCT/JP2004/001285
§ 371 (c)(1),
(2), (4) Date: Aug. 5, 2005

(87) PCT Pub. No.: WO2004/069363
PCT Pub. Date: Aug. 19, 2004

(65) Prior Publication Data

US 2007/0000203 A1 Jan. 4, 2007

(30) Foreign Application Priority Data

Feb. 7, 2003 (JP) ..... 2003-000568
Sep. 1, 2003 (JP) ..... 2003-309198

(51) Int. Cl.
*A63H 33/08* (2006.01)

(52) U.S. Cl.
USPC ..... 446/106

(58) Field of Classification Search
USPC ..... 446/106
See application file for complete search history.

(56) References Cited

U.S. PATENT DOCUMENTS 2,132,757 A 10/1936 Paulson
2,440,836 A 5/1948 Turngren (Continued)

FOREIGN PATENT DOCUMENTS

FR 956536 2/1950
FR 1015385 9/1952

(Continued)

OTHER PUBLICATIONS

English Translation of the International Preliminary Examination Report Completed on Feb. 23, 2006.

(Continued)

*Primary Examiner* — Michael Dennis
(74) *Attorney, Agent, or Firm* — Rader, Fishman & Grauer PLLC

(57) ABSTRACT

A set of building blocks are provided for building up to a unique structure using substantially simply designed blocks. The building blocks according to the present invention are classified into a first piece P1 and a second piece P2. The first piece P1 has a groove G provided therein of which two surfaces Ga, Ga are tilted symmetrically from the reference plane H orthogonal to a flat plane S or a plane S' including the flat plane S. The bottom Gb of the groove G extends parallel with the flat plane S. The second piece P2 has at least a corner edge thereof arranged at a right angle, when viewed in the lengthwise direction of the groove G, to engage with the groove G with its one side Af coming substantially in face contact with the grooves G. In particular, the width WS of the flat plane S is greater than the width WG of the groove G along the direction perpendicular to the reference plane H while the flat plane S and the groove G are coincided with each other at the center of the width WS, WG.

15 Claims, 13 Drawing Sheets

U.S. PATENT DOCUMENTS

| | | | | |
|---|---|---|---|---|
| 3,303,604 | A * | 2/1967 | Mote | 446/124 |
| 3,660,928 | A * | 5/1972 | Michel | 446/124 |
| 3,863,918 | A | 2/1975 | Kramer | |
| 4,197,669 | A | 4/1980 | Hynes | |
| 4,372,076 | A | 2/1983 | Beck | |
| 6,116,981 | A * | 9/2000 | Zheng | 446/106 |

FOREIGN PATENT DOCUMENTS

| | | | |
|---|---|---|---|
| JP | 56-31783 | A | 3/1981 |
| JP | 62-161391 | A | 7/1987 |
| JP | 11-319333 | A | 11/1999 |

OTHER PUBLICATIONS

Edited by Toshiichiro Narita, "Mokuzai Kogei Yogo Jiten", (3rd edition), Rikogakusha, Jun. 15, 1979 (Jun. 12, 1979), p. 215.
International Search Report mailed on Mar. 16, 2004.
International Preparative Examination Report.
Office Communication dated Feb. 1, 2008 (EPO).

* cited by examiner

Fig 18
(a)
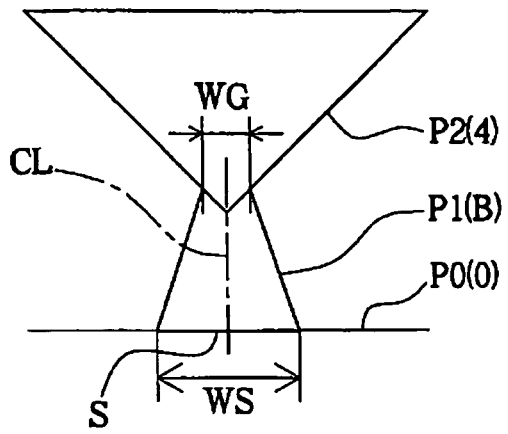
(b)
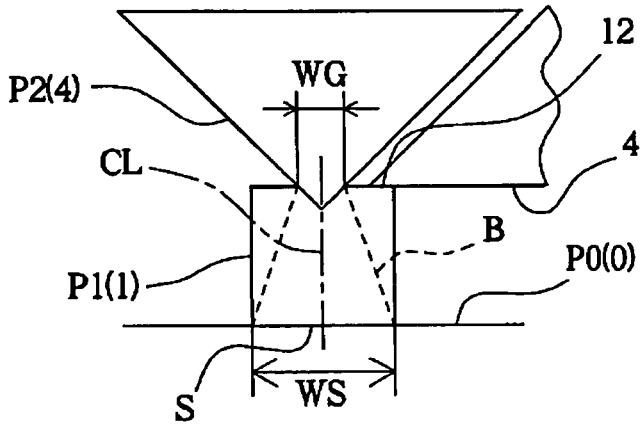
(c)
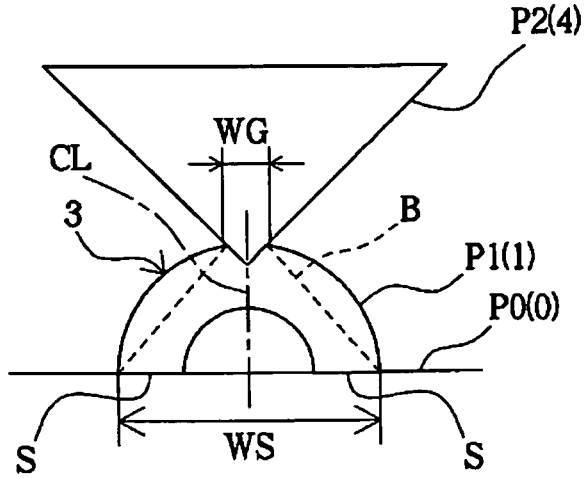

BUILDING BLOCKS

FIELD OF THE INVENTION

The present invention relates to a set of building blocks for building up together and fitting to each other, for example, as a toy or a decorative object to assist the development of a child's brain and the rehabilitating action of a disabled person.

BACKGROUND OF THE INVENTION

A conventional set of building blocks include various shapes of wooden blocks which can simply be built up one over another from lower to upper. It is hardly contemplated to place, for example, a triangle block in its inverted form on the horizontal plane. A resultant building of blocks will thus be far from uniqueness.

As disclosed in Japanese Patent Laid-open Publication (Heisei) 11-319333, a modification has been proposed in which each block has four sides equally recessed in the surface thereof. It is however troublesome to fabricate the equally recessed sides of the block. When the recessed blocks are built up one over another, their recessed sides have to join with each other. This joining action is equal to that of the conventional blocks and may give a limitation on the building pattern.

Also, another modification including some blocks provided with V-shaped grooves is disclosed as a building toy in Japanese Patent Laid-open (Showa)56-31783. The blocks are arranged with the V-shaped groove substantially identical in the width to the surface of the other side so that it can neatly engage with the top of a roof block, hence exhibiting no balancing favor nor shaping uniqueness.

DISCLOSURE OF THE INVENTION

It is hence an object of the present invention in view of the foregoing aspects to provide a set of building blocks which can be built up to a unique structure using substantially simply designed blocks.

For achievement of the object, the building blocks according to the present invention are characterized by a first piece having a groove provided therein of which two surfaces are tilted symmetrically from the reference plane orthogonal to a flat plane or a plane including the flat plane and of which bottom extends parallel with the flat plane and a second piece having at least a corner edge thereof arranged at a right angle, when viewed in the lengthwise direction of the groove, to engage with the groove with its one side coming substantially in face contact with the grooves, wherein the width of the flat plane is greater than the width of the groove along the direction perpendicular to the reference plane so that a combination of the building blocks built up can have a twist in the intermediate, and the flat plane and the groove are coincided with each other at the center of the width, whereby the building blocks of the first pieces and/or the second pieces can be built up with the joint between the corner edge and the groove and/or the joint between the plant planes in balance as a whole.

According to the foregoing arrangement, as shown in FIGS. 12 and 13*a*, when the corner edge A of the second piece P2 is closely engaged with the groove G arranged in a V-shaped ditch or groove form, the second piece P2 remains inclined relative to the first piece P1. The inclination can thus create a unit structure where the blocks are balanced finely. In the drawings, the flat plane and the groove are matched at the center of the width WS and the width WG respectively with the reference plane H.

As further characterized, the first piece may be arranged of a semi-circular cylindrical shape having the groove provided axially in the uppermost of a top side thereof and a recess of a semi-circular column shape provided axially in the widthwise center of a bottom side thereof. This allows the blocks to be arranged of such a shape as shown in FIG. 4 which is unique and different from the typical building blocks of the prior art, whereby the combination can be modified in more variations as shown in FIGS. 10*a* to 10*c*.

As further characterized, the second piece may be arranged, while a pair of the first pieces are used, in that one side at one of the two corner edges of the second piece extends parallel with one side at the other of the two corner edges and both the one sides are located at the same side of the second piece so that each flat plane of the first piece is tilted at 45 degrees to the horizontal plane to engage the corner edge with the corresponding groove.

This allows a pair of the corner edges A1, A1 to be engaged with the grooves G, G of the corresponding first pieces P1, P1 respectively as shown in FIG. 10*a*. Alternatively, this allows the second piece P2 to be bridged between the two first pieces P1, P1 as shown in FIG. 10*c*, thus expanding a structure of the building blocks in the horizontal.

As further characterized, the first piece of which the flat plane tilted at 45 degrees may be supported by a triangle block which has 45-degree corner edges and can be removed when a combination of the building blocks have been built up.

As further characterized, the second piece may be arranged, while a pair of the first pieces are used, in that one side at one of the two corner edges of the second piece extends parallel with one side at the other of the two corner edges and both the one sides are located at the same side of the second piece so that the two corner edges of the second piece is engaged with the corresponding groove in the first piece to make a face contact between the recess 56 of a recessed triangle block 5 and the bottom side 31 of the first piece.

As further characterized, the second piece may consist of two blocks which have substantially a right angle developed by jointing two corner edges of substantially 45 degrees so that the two joined corner edges at either upper or lower side can be engaged with the groove in each the first piece.

This allows two blocks having a corner edge A3 at substantially 45 degrees to be joined together to develop the second piece P2 as shown in FIG. 9*d*. As the second piece P2 is modified in the shape, its combination can be increased in the number of patterns.

As further characterized, a pair of cube blocks serving as the second pieces may be placed in their 45 degrees tilted form on the horizontal plane, followed by the first piece being fitted on the corner edge of each cube block and another block being placed on the flat planes of the two first pieces.

For further understanding of the actions and advantages of present invention, the combination shown in FIGS. 12 and 14*a* will be explained in comparison with other combinations. As apparent from the drawings, the combination of the first piece P1 and the second piece P2 according to the present invention is implemented by a long square shaft block 1A placed over a triangle block 4. When the triangle block 4 receives an inclined load, the combination will fall down from the joint Jg but not the base because the width WG of the groove G is smaller than the width WS of the flat plane S.

Comparatively as shown in FIG. 14*b*, a first piece 1' has the width WS' of a flat plane S arranged equal to the width WG of a groove and its combination will fall down from the joint Jf" with the flat plane S in a known manner.

FIG. 14*c* illustrates a combination where a trapezoid block 4' arranged by truncating a triangle and having a small side Sm at the top is used for allowing the combination to fall down from an intentionally narrowed joint. When the trapezoid block 4' is slightly tilted to disturb the balance of the combination, the weight of a long square shaft block 1A acts on the narrow joint Jf' causing the trapezoid block 4' to drop down. As the combination is highly unstable, it will create no fun. With no use of the grooves, the centering of the blocks becomes troublesome thus making the building up of the blocks difficult. In fact, when the triangle block 4 and the trapezoid block 4' shown in FIGS. 14*a*, 14*b*, and 14*c* are slightly tilted under the same condition, the combinations shown in FIGS. 14*b* and 14*c* will fall down from the joints Jf' and Jf" quicker than the combination shown in FIG. 14*a*.

FIG. 15 is an enlarged view of the second piece P2 tilted relative to the first piece P1, showing a periphery of the groove. When the second piece P2 is tilted relative to the first piece P1, its portion directly facing the corner edge L1 of the first piece P1 is shifted by a distance d1 to the location L2 or the corner edge A of the second piece P2 is moved by a distance d2 from the bottom Gb of the groove. During the movement by d1 or d2, a frictional resistance will however be developed. This prevents the corner edge A of the triangle block 4 from moving out from the groove G. For comparison, since a trapezoid block 4' (P2') shown in FIG. 15*b* has its portion L3 held in contact with the first piece P1 but its other portion L4 kept movable, its inclination will hardly be prevented by any counter force. In brief, while the falling down at the joint Jg is permitted by the width WG of the groove arranged smaller than the width WS of the flat plane, the frictional resistance between the corner edge A and the groove G can prevent the falling down at the joint Jg. The greater the load, the higher the frictional resistance will increase. Accordingly, when the blocks are built up higher, the joint Jg will be more stable.

It is now assumed referring to FIG. 15*a* that the center line of the block is tilted at an angle M from the center of the groove G as the corner edge A moves. The smaller the groove width WG, the greater the angle M will be increased so long as the distance d2 remains unchanged. Accordingly, when the groove width WG is smaller as compared with the width WS of the flat plane S, the block is tilted through a greater range of the angle M and its tilting can be controlled with much ease. The present invention permits the tilting of the block against the horizontal to be favorably compensated by the functional movement of the joint Jg.

FIG. 14*d* illustrates a functional model of the compensating movement for ease of theoretical understanding of the advantageous combination shown in FIG. 14*a*. The joint Jg is expressed by a V symbol while the joint Jf with the flat plane S is denoted by the circle and the direction of the groove is denoted by OL1. In detail, the floor 0 is a member of the functional movement and thus applied as a base piece P0. The base piece P0 may be replaced by any other building block. In this application, a group or first set G1 of the floor 0, the cube block 1, and the triangle block 4 are referred to as a unit of the combination.

The above advantageous combination remains unchanged when the flat plane S and the groove G are inverted upside down as shown in FIGS. 16*a* and 16*b*. As shown, both the first piece P1 and the second piece P2 are cube blocks. As the flat plane S on the first piece P1 is supported by the bottom side 41 of the triangle block 4 serving as the base piece P0, the second piece P2 can be held in stableness. More particularly, the triangle block 4 and the two cube blocks 1 constitute a second set G2 which is a reverse of the first set G1, showing the unit of the combination.

FIG. 17 illustrates more intricate examples of the combination. As a third group G3 and a fourth group G4 remain unchanged, a fifth group G5 is placed upside down. The third group G3 is differentiated from the fourth group G4 by the fact that the direction of the groove is different between OL1 and OL2, showing variations.

The models of the combination shown in FIGS. 14*d*, 16*b*, and 17*c* will be explained in summary. In the first to fifth groups, a force of compression is generated between the base piece P0 and the second piece P2 due to the specific gravity and the weight of the other blocks. The force of compression will create the above described movement. Each group involves both the restriction by the effect of the grooves G and the freedom on the flat plane S. The groove G still has a degree of freedom for offsetting an error created by the blocks built up on the flat plane S. No conventional building blocks can incorporate such a rigid and organic functional combination between the blocks.

FIG. 18*a* illustrates a fundamental shape B of the first piece P1. The groove width WG is coincided at the center line CL with the width WS of the flat plane S. The fundamental shape B may be modified to such a cubic shape 1 as shown in FIG. 18*b* or such a doughnut half shape 3 as shown in FIG. 18*c*. As shown in FIG. 18*b*, the cube block 1 has a top side 12 thereof margined for engagement with a triangle block 4 at the intermediate. The top side 12 of the cube block 1 can thus be utilized at optimum.

As further characterized, both the sides at the corner edge may be arranged to come substantially in face contact with the groove. Also, the other side at the corner edge may be arranged of a cylindrical plane to come substantially in linear contact with the groove. This enables not only the combination shown in FIG. 12 where the block is held with its two sides Af and Af coming in face contact with the groove G but also other variations of the combination such as shown in FIGS. 13*a* and 13*b* where the cylindrical side Ar is held up.

As further characterized, the ridge line Ab along the corner edge at each end of the flat plane may extend parallel with the lengthwise bottom Gb of the groove. This allows the engagement of the second piece P2 with the groove G to be implemented with the blocks tilted as shown in FIG. 10*c*, thus ensuring to build up a unique structure with balance.

As further characterized, the second piece may have the flat plane and the groove. This allows the first piece P1 to serve as the second piece P2 fitted into the groove, as shown in FIG. 10*b*. Alternatively, as shown in FIG. 10*c*, another small triangle block 4A can be fitted into the groove G of the long square shaft block 1A which has engaged with the grooves G of the two doughnut half blocks 3, thus permitting a less number of the blocks to build up a more intricate structure of the combination.

As further characterized, the first piece may be arranged of fundamentally a cubic shape, a rectangular parallelepiped shape, and/or a cylindrical shape. This allows any conventional building block of a typical shape to be provided with a groove G, such as shown in FIG. 2 or 3, and thus combined with the second piece P2, this building up a structure of the combination different from that of the prior art.

As further characterized, the second piece may be arranged of fundamentally a right-angle isosceles shape. This allows every corner edge at the right angle to be engaged with the groove, whereby an inverted form of the combination can be implemented as is hardly feasible in the prior art, as shown in FIG. 1*a*.

As set forth above, the building blocks according to the present invention are unelaborate and inexpensive in the fabricating process where the first piece is provided simply with a groove. Their advantages are as follows:

1) Since the width of the flat plane is greater than the width of the groove along the direction perpendicular to the reference plane, the combination of the blocks can be permitted to fall down easily at the joint with the grooves as compare with that built simply on the flat plane and simultaneously ensured to provide a degree of stability due to the frictional resistance developed in the grooves at the joint.

2) Since the flat plane and the groove are coincided with each other at the center of the width, the combination of the blocks at the unstable joint can be less affected by a lateral stress thus allowing the centering of the upper and lower blocks to be carried out with much ease.

3) Since the second piece is fitted at the corner edge into the groove, it can be tilted relative to the first piece thus allowing a visually unique structure of the blocks to be built up.

4) Since the groove is narrower in the width than the unit side, the combination of the blocks can develop a twist in the intermediate thus exhibiting a visual uniqueness.

According to the present invention, more modifications of the combination may be made of which the advantages are as follows:

5) Since the groove is narrower in the width than the flat plane, the inclination between the blocks can finely be controlled at any intermediate time to offset an error created during the building up of the blocks.

6) Since the joint between the groove and the flat plane has a degree of design freedom, it can favorably be modified in the configuration thus permitting more visual variations of the combination.

7) While the building up of the blocks over the flat plane is free in the direction, the engagement with the grooves is significantly directional. Accordingly, when the building up of the blocks on the flat plane is conducted so that all the grooves extend in the same direction, the combination can be balanced on the plane perpendicular to the grooves. Alternatively, when the building up of the blocks on the flat plane is conducted so that the grooves extend in different directions, the combination can be balanced in three dimensions. As a result, more variations of the structure can be enjoyed.

With any combination of the above advantages, the combination of the building blocks can produce an apparently contradictory effect or feature where its structure appears visually attractive, unique, and fragile and when loaded, becomes stable, thus improving the performance as a play toy or a decorative object. Also, as the building blocks are provided with the grooves, they can be used as conventional blocks while ensuring the above described novel advantages.

Other objects, arrangements, features of the present invention will be apparent from the detailed description in "Best Mode for embodying the Invention".

BRIEF DESCRIPTION OF THE DRAWINGS

FIG. 11 is a front view showing a combination of the blocks;

FIGS. 18*a*, 18*b*, and 18*c* are a front view showing a combination of the blocks, a front view showing a modification of the same, and a front view showing another modification of the same respectively.

BEST MODES FOR EMBODYING THE INVENTION

The present invention will be described in more detail referring to the accompanying drawings.

Figure 1:
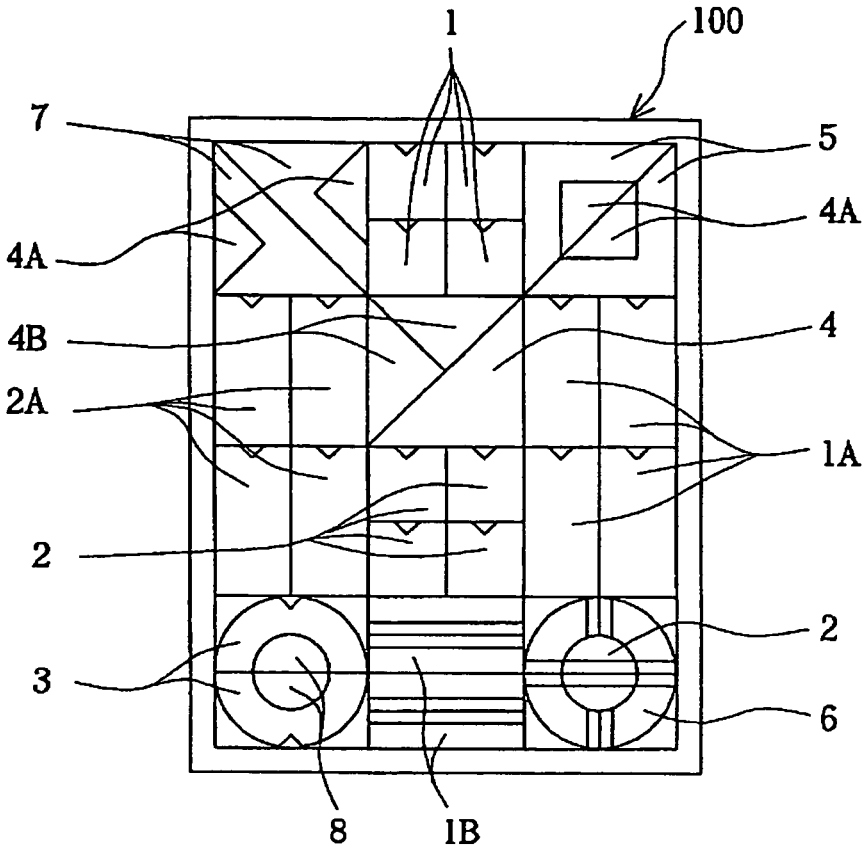
FIG. 1 is a plan view showing a set of building blocks arranged in the storage form according to the present invention.
Figure 2:
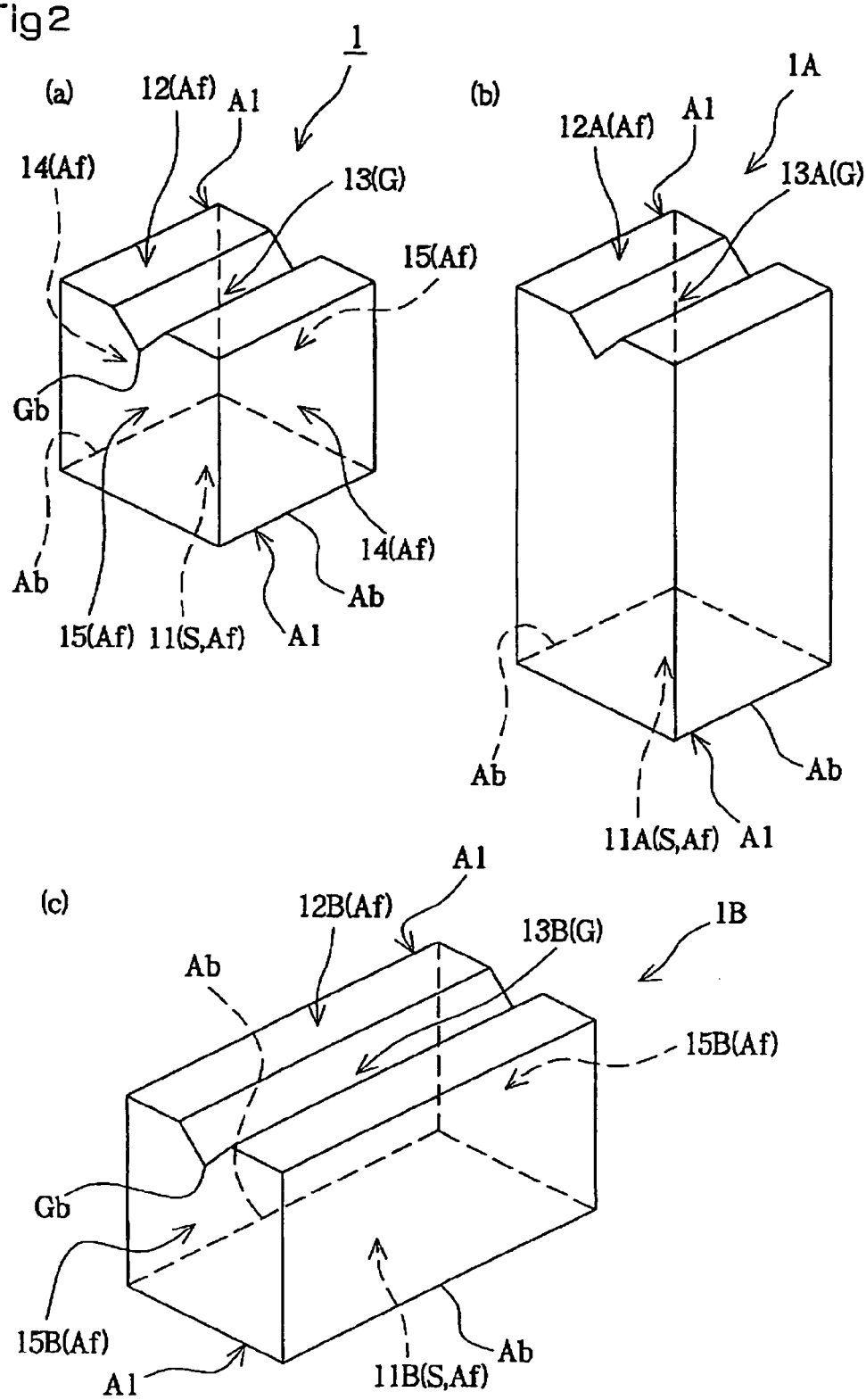
FIGS. 2*a*, 2*b* and 2*c* are a perspective view of a square shaft block, a perspective view if another square shaft block which is two times greater in the height than the block shown in FIG. 2*a*, and a perspective view of a further square shaft block which is substantially two times greater in the thickness than the block shown in FIG. 2*a* respectively.
Figure 3:
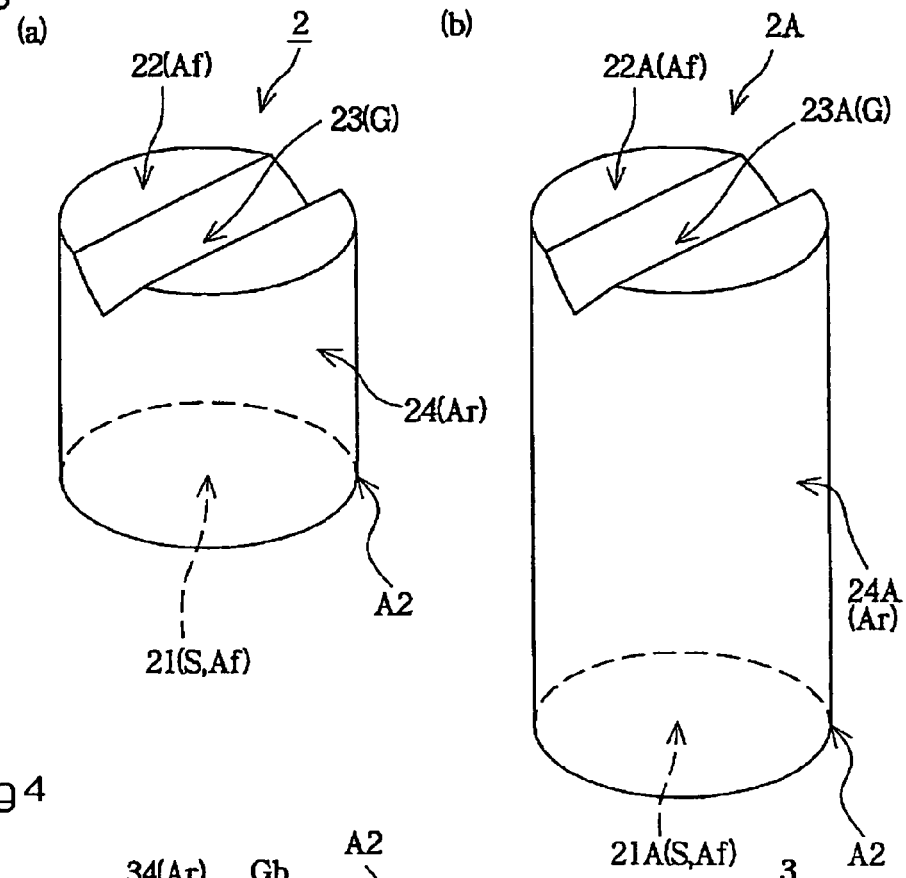
FIGS. 3*a* and 3*b* are a perspective view of a cylinder block and a perspective view of another cylinder block which is two times greater than the block shown in FIG. 3*a* respectively.

A set of building blocks according to the present invention are stored in a box 100 which is equal in the thickness to the blocks, as shown in FIG. 1. The building blocks are arranged of such shapes as shown in FIGS. 2 to 7. The blocks are substantially equal in the thickness and their dimensional radio of the vertical to the horizontal is as uniform as 1:2. It is then assumed in this embodiment that the unit dimension is 35 mm and its doubled dimension is 70 mm.

Figure 12:
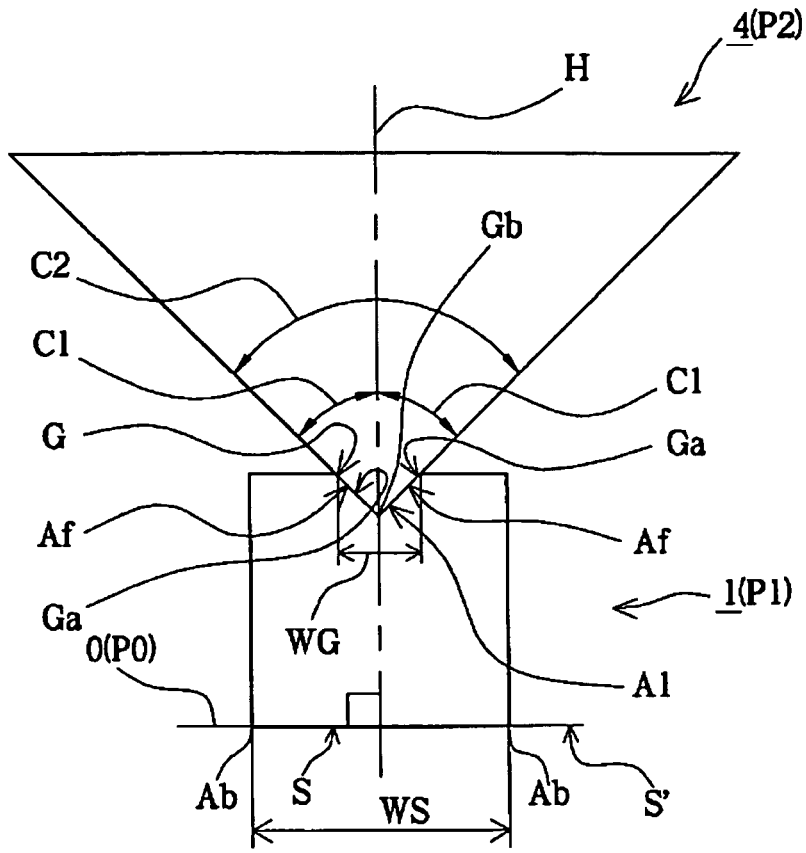
FIG. 12 is a front view showing a detailed relationship between the blocks.
Figure 13:
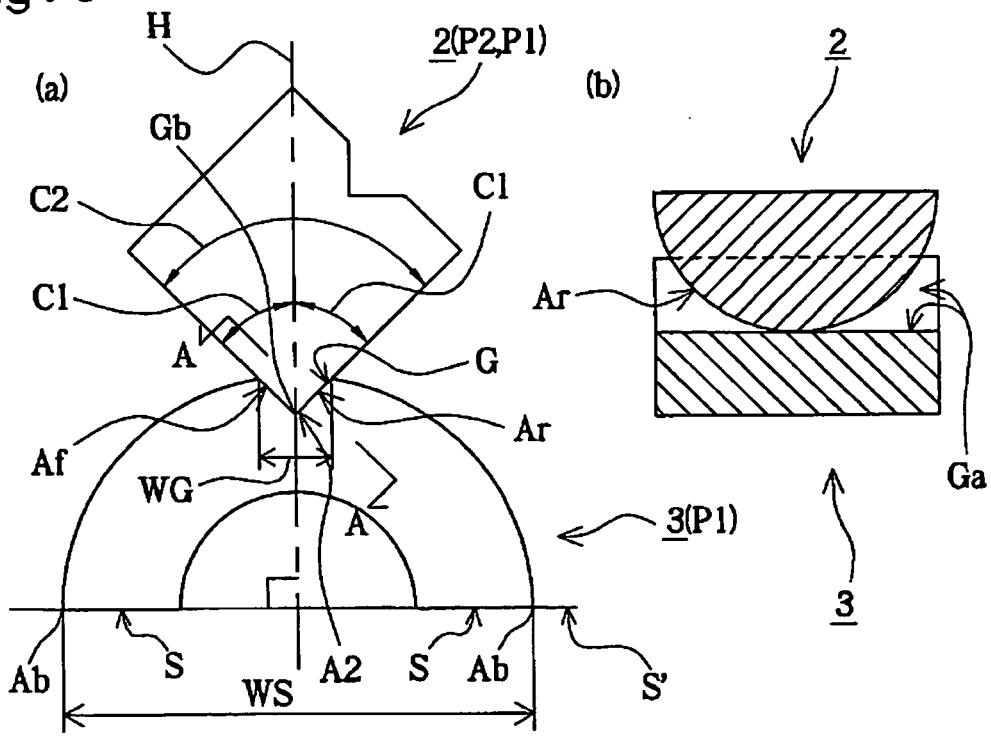
FIGS. 13*a* and 13*b* are a front view showing another detailed relationship between the blocks and a cross sectional views taken along the line A-A of FIG. 13*a* respectively.
Figure 14:
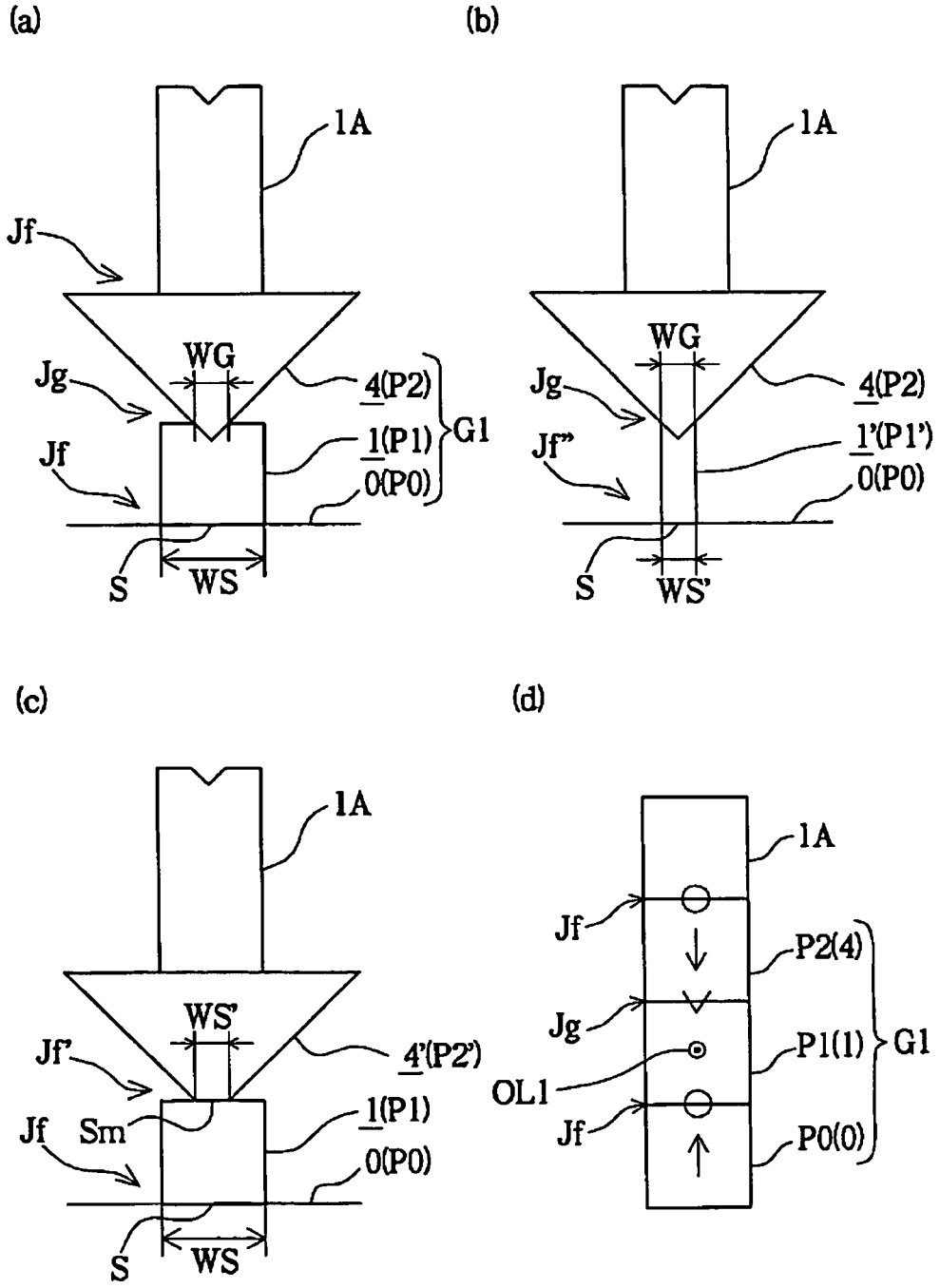
FIGS. 14*a*, 14*b*, 14*c*, and 14*d* are a front view of a combination of the blocks, a front view of a combination of the block which are substantially equal in the width between the groove and the bottom, a front view of a combination of the blocks which have no grooves, and a functional model diagram of the combination shown in FIG. 14*a* respectively.

The building blocks include a first piece P1 having a groove G, which will be described later in more detail, and a second piece P2 arranged to be accepted by the groove G, as best shown in FIG. 12. The two pieces are simply relative to each other. The first piece P1 provided with the groove G may serve as the second piece P2 in the combination as shown in FIG. 13*a*. The two pieces P1 and P2 are placed one over the other, starting from the floor 0.

Some primary shapes of the building blocks of the embodiment will now be explained.

Referring to FIG. 2*a*, a cube block 1 has each side thereof sized by the square of the unit dimension, including a bottom side 11 having a flat plane S and a top side 12 which extends parallel with the bottom side 11 and has a V-shaped groove 13 scored substantially across the center thereof. The top and bottom sides are parallel and identical in the shape. Accordingly, as the groove 13 is provided in substantially the center of the top side 12, the center of the width WS of the planer surface S of the bottom side 11 and the center of the width WG of the groove 13 are coincided with each other at the reference plane H. This can be equal to the other blocks of which the top and bottom sides are identical in the size. While the two opposite sides are parallel with each other, a right-angled linear corner edge A1 is defined between any adjacent two of the bottom side 11, the top side 12, the two lateral sides 14, 14, and the two, front and rear, sides 15, 15. Also, the bottom Gb of the groove 13 extends parallel with the ridge line Ab along the right-angled linear corner edge A1 between the bottom side 11 and the lateral side 14.

Figure 5:
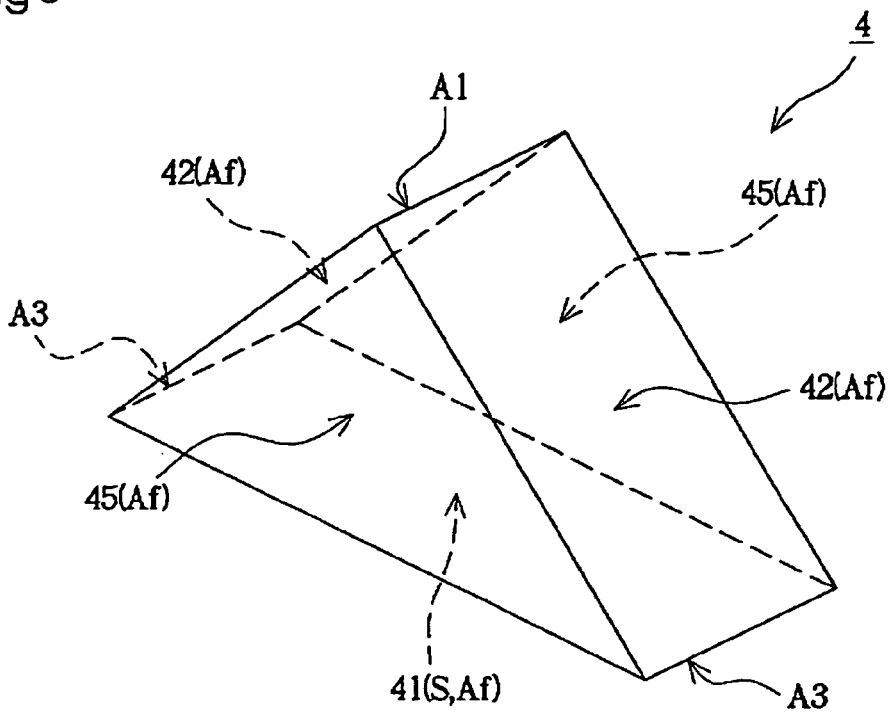
FIG. 5 is a perspective view of a triangle block.

FIG. 5 illustrates a triangle block 4 arranged of a triangular prism shape comprising a bottom side 41 having a flat plane S, two sloping sides 42, 42 having a flat plane Af, and two, front and rear, sides 45, 45 having a flat plane Af which extend parallel with each other and are of a right isosceles shape having two equal side lines along the sloping sides 42, 42. Each of the two equal side lines of the right isosceles shape of the two, front and rear, sides 45, 45 is equal to two times the unit dimension while the thickness or distance between the two sides 45, 45 is equal to the unit dimension. A triangular corner edge A3 is defined between the bottom side 41 and the sloping side 42 intersecting at 45 degrees while a right-angled linear corner edge A1 is defined between the two sloping sides 42, 42.

The cube block 1 and the triangle block 4 can be assembled in such a combination as shown in FIG. 12 where the groove G of the cube block 1 accepts the right-angled linear corner edge A1 of the triangle block 4. In this case, the cube block 1 serves as the first piece P1 and the triangle block 4 serves as the second piece P2. The groove G in the cube block 1 is defined by the groove bottom Gb and two groove surfaces Ga. The groove surfaces Ga are symmetrically tilted at substantially 45 degrees of the tilting angle C1 from the reference plane H orthogonal to the flat plane S. The groove bottom Gb extends parallel with the ridge line Ab along the right-angled linear corner edge between the two flat planes S as is disposed at which the two groove surfaces Ga intersect each other at substantially 90 degrees of the groove angle C2. It is now noted that the depth of the groove G is 6 mm orthogonally from the top side as will be identical to that of each groove.

When the groove G accepts the right-angled linear corner edge A1 of the triangle block 4, its two surfaces Ga come into face contact with the two flat planes Af which define the right-angled linear corner edge A1 therebetween. Since the weight of the triangle block 4 is uniformly received by the two groove surfaces Ga, the blocks can be built up with balance.

FIG. 2*a* illustrates a long square shaft block 1A arranged of a vertically extending parallelepiped shape which is two times greater in the height than the cube block 1, including a bottom side 11A and a top side 12A which are identical to the bottom side 11 and the top side 12 of the cube block 1. A groove 13A identical in the shape to the groove 13 is provided in substantially the center of the top side 12A to extend from the front side to the rear side. While each of the bottom side 11A and the top side 12A is sized by the square of the unit dimension, the height of the block 1A is equal to two times the unit dimension.

FIG. 2*c* illustrates a wide square shaft block 1B arranged of a thicknesswisely extending parallelepiped shape which is two times greater in the thickness along the groove bottom Gb than the cube block 1, including a bottom side 11B, a top side 12B, and two, front and rear, sides 15B, 15B which are identical to the two, front and rear, sides 15, 15 of the cube block 1. A groove 13B identical in the shape to the groove 13 is provided in substantially the center of the top side 12B to extend in the thicknesswise direction. While the distance between the bottom side 11B and the top side 12B is equal to the unit dimension, the length of the groove Gb as the thickness of the block is equal to two times the unit dimension. A right-angled linear corner edge A1 is defined between any two adjacent sides of either the long square shaft block 1A or the wide square shaft 1B. The ridge line Ab along the right-angled linear corner edge between the bottom side 11A or 11B and the lateral side extends parallel with the groove bottom Gb. Also, any two opposite planes Af are parallel with each other.

FIG. 3*a* illustrates a cylinder block 2 arranged of a cylindrical shape including a bottom side 21 having a flat plane S, a top side 22 arranged in parallel with the bottom side 21, and a lateral side 24 having a cylindrical plane Ar. A groove 23 is scored along the diameter in the top side 22. The height and the diameter of the bottom side 21 and the top side 22 are equal to the unit dimension. A circular corner edge A2 at a right angle is defined between the flat plane Af and the cylindrical plane Ar.

Figure 4:
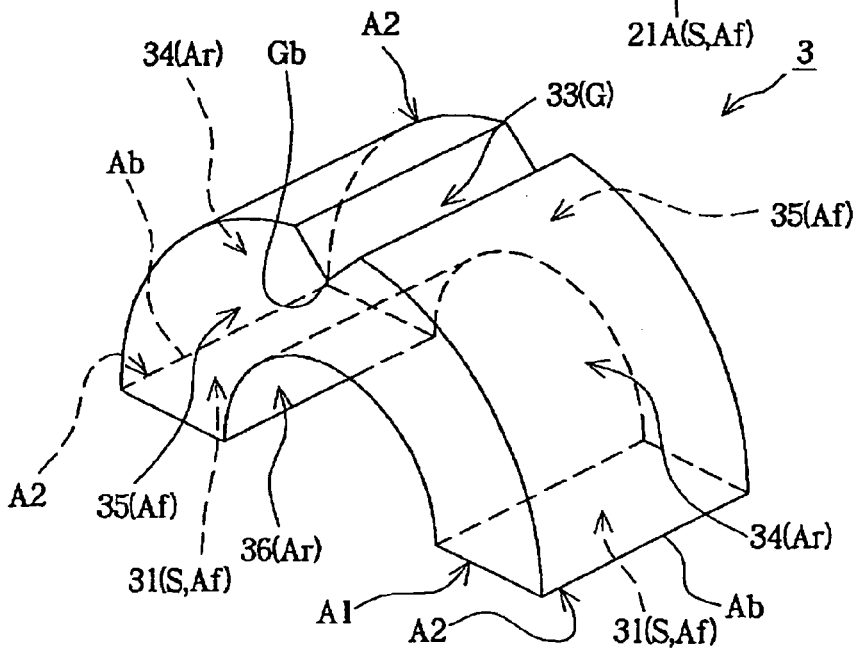
FIG. 4 is a perspective view of a doughnut half block.

FIG. 4 illustrates a doughnut half block 3 arranged of a semi-circular cylindrical shape including a bottom side 31 having a flat plane S, a top side 34 having an arcuate plane Ar, and two, front and rear, sides 35, 35 having a fan-shaped flat plane Af and arranged in parallel with each other. A groove 33 is scored along the axial direction in the uppermost end of the top side 34. The bottom side 31 has a recess 36 of a semi-circular cylindrical shape provided axially in the center along the widthwise direction thereof. The thickness along the length of the groove Gb and the diameter of the notch 36 are equal to the unit dimension. Also, the width of the bottom side 31 is equal to the unit dimension. A right-angled linear corner edge A1 is defined between the flat plane Af and the flat plane S. Defined between the flat plane Af and the arcuate plane Ar is an arcuate side linear corner edge A2 at the right angle. The ridge line Ab along the arcuate side corner edge A2 extends parallel with the bottom Gb of the groove 33.

The cylinder block 2 and the doughnut half block 3 may be assembled together as shown in FIG. 13*a*. The doughnut half block 3 serves as the first piece P1 while the cylinder block 2 serves as the second piece P2. The groove G in the doughnut half block 3 is identical in the construction to the groove G in the cube block 1 and is arranged in which its side surfaces Ga are symmetrically tilted at substantially 45 degrees of the tilting angle C1 from the reference plane H orthogonal to the flat plane S. The two surfaces Ga intersect each other at substantially 90 degrees of the groove angle C2 along the bottom Gb of the groove G and the ridge line Ab along the right-angled linear corner edge adjacent to the flat plane S extends parallel with the flat plane S.

When the groove G accepts the circular corner edge A2 of the cylinder block 2, its surface Ga comes into face contact with the flat plane Af which is defined by the circular corner edge A2. Simultaneously, the cylindrical plane Ar defined between the two circular corner edges A2 comes into linear contact with the groove surface Ga. Since the weight of the cylinder block 2 is uniformly received by the groove surface Ga at the face contact and the other groove surface Ga at the linear contact, the blocks can be built up with balance.

FIG. 3*b* illustrates a long cylinder block 2A arranged of a vertically extending cylindrical shape which is two times greater in the height than the cylinder block 2, including a bottom side 21A and a top side 22A which are identical to the bottom side 21 and the top side 22 of the cylinder block 2, and a lateral side 24 having a cylindrical plane Af. A groove 23A identical in the shape to the groove 23 is scored along the diameter in substantially the center of the top side 22A. A circular corner edge A2 at a right angle is defined between the flat plane Af and the cylindrical plane Ar. The height of the block 2A is equal to two times the unit dimension.

Figure 6:
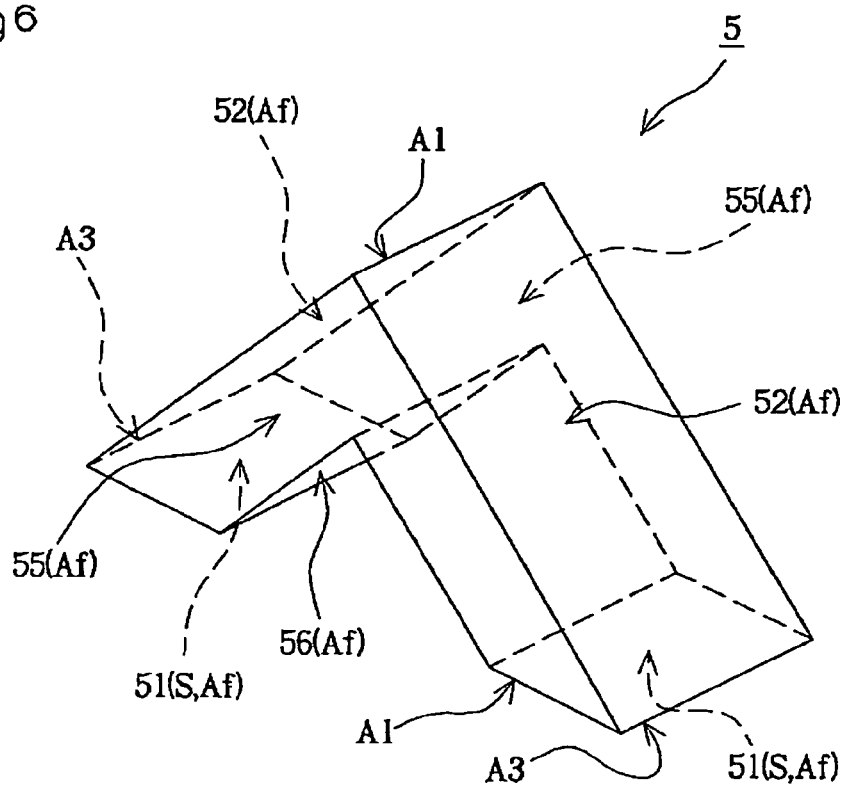
FIG. 6 is a perspective view of a recessed triangle block.

FIG. 6 illustrates a recessed triangle block 5 arranged substantially identical in the shape and size to the triangle block 4, including a bottom side 51 having a flat plane S and two, front and rear, sides 55, 55 having a flat plane Af which extend parallel with each other and are of a right isosceles shape having two equal side lines defined by two sloping sides 52, 52 of flat plane Af. A recess 56 is provided in the center of the bottom side 51 extending thicknesswisely between the two, front and rear, sides 55, 55. The recess 56 is arranged of a right isosceles shape in the cross section for accepting the right-angled linear corner edge of any other block. The width of the recess 56 is equal to the unit dimension while each of the two sloping side lines of the recess 56 extends 36 mm. A triangular corner edge A3 is defined between the bottom side 51 and the sloping side 52 which intersect each other at 45 degrees while a right-angled linear corner edge A1 between the two sloping sides 52, 52 extends from the front side 55 to the rear side 55.

Figure 7:
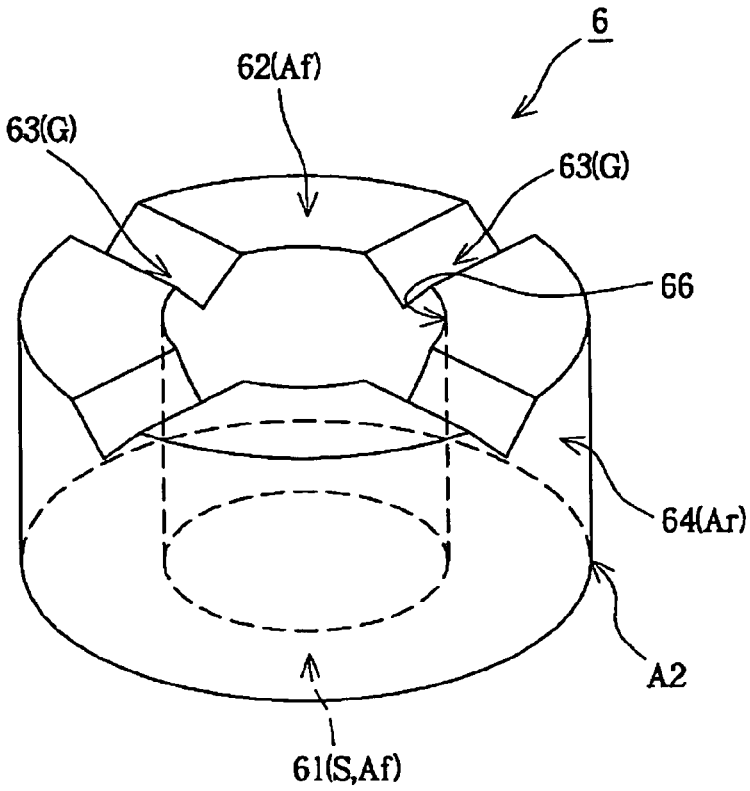
FIG. 7 is a perspective view of doughnut block.

FIG. 7 illustrates a doughnut block 6 arranged of a hollow cylindrical shape, including a bottom side 61 having a flat plane S, a top side 62 arranged parallel with the bottom side 61, and a lateral side 64 having a circular plane Ar. The doughnut block 6 has a through hole 66 provided axially in the center thereof. Two grooves 63, 63 are provided along the diameter in the top side 62 as intersect each other. The diameter of the bottom side 61 and the top side 62 is equal to two times the unit dimension while the height of the block 6 is equal to the unit dimension. As its diameter is 36 mm, the through hole 66 generously accepts the cylinder block 2 or the long cylinder block 2A. A circular corner edge A2 at the right angle is defined between the flat plane Af and the circular plane Ar.

Referring to FIG. 12, further provided are a small triangle block 4A, a middle triangle block 4B, a narrow block 7, and a cylinder half block 8. The small triangle 4A is similar in the shape to the triangle block 4 as its scale ratio to the triangle block 4 is 1:2. The middle triangle block 4B is a right isosceles identical to substantially a half of the triangle block 4 provided by dividing vertically along the center line from the right angle vertex. The arrow block 7 has such a shape that a right isosceles equal to the small triangle block 4A is reduced at the linear corner edge A1 from the triangle block 4. The cylinder half block 8 is equal to substantially a half of the cylinder block 2 provided by dividing vertically along the center line.

The triangle block 4 and the small triangle block 4A can serve as the second piece P2. The other blocks 4B, 7, and 8 can serve as either the first P1 or second piece P2.

Some examples of the combination of the building blocks will be described referring to FIGS. 8 to 11.

Figure 8:
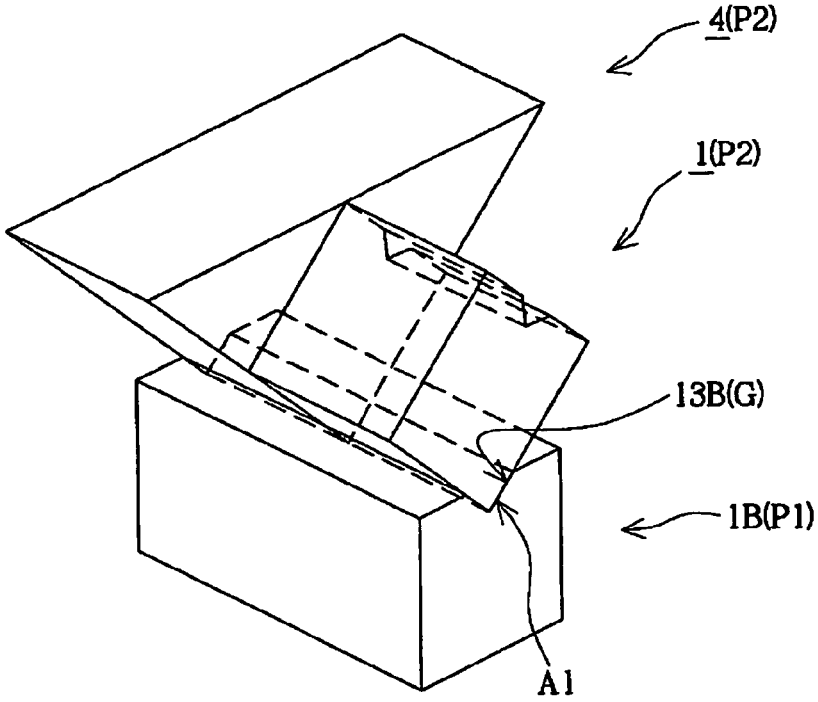
FIG. 8 is a perspective view showing a combination of the blocks.
Figure 9:
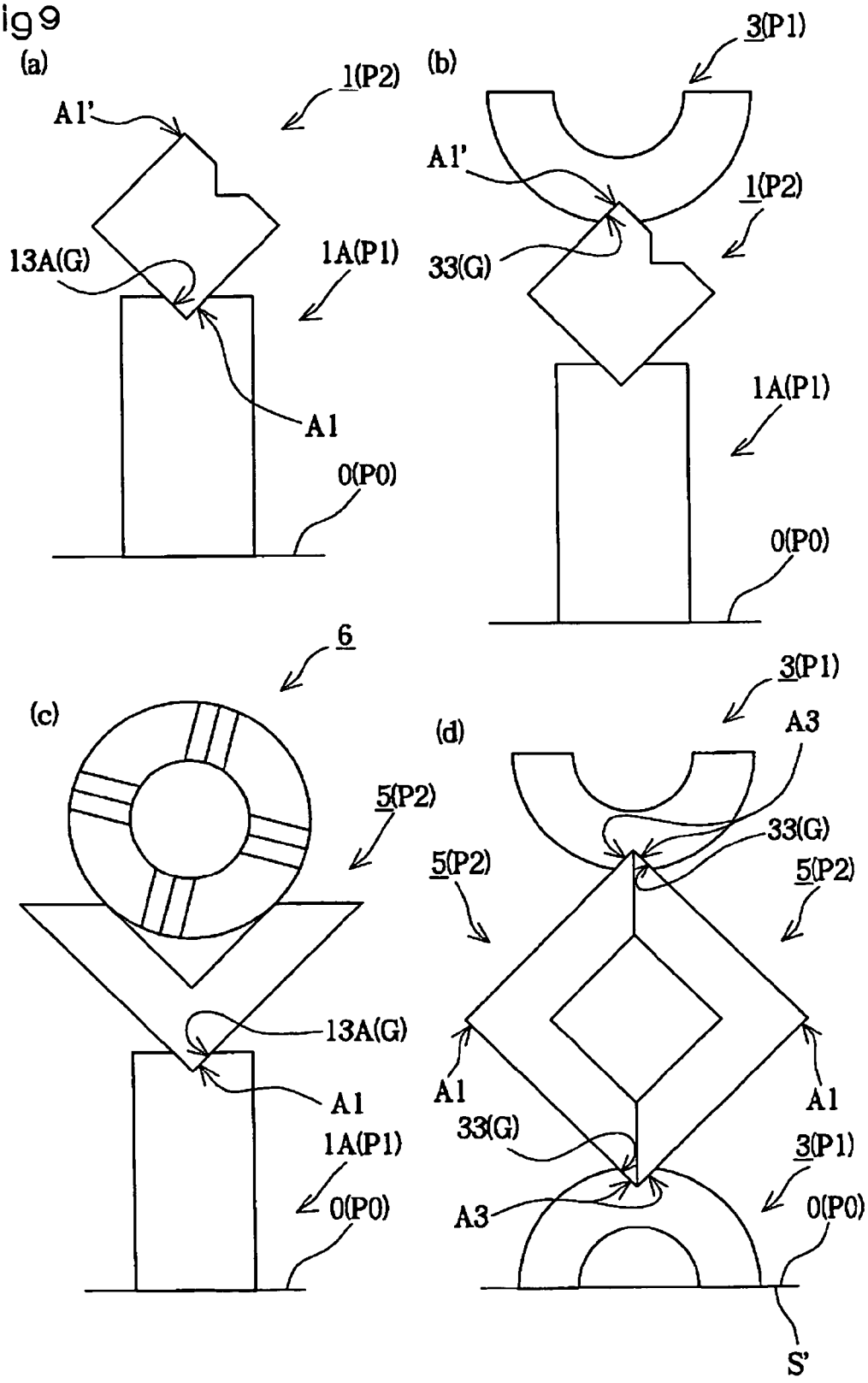
FIGS. 9*a* to 9*d* are front views showing different combinations of the blocks.
Figure 10:
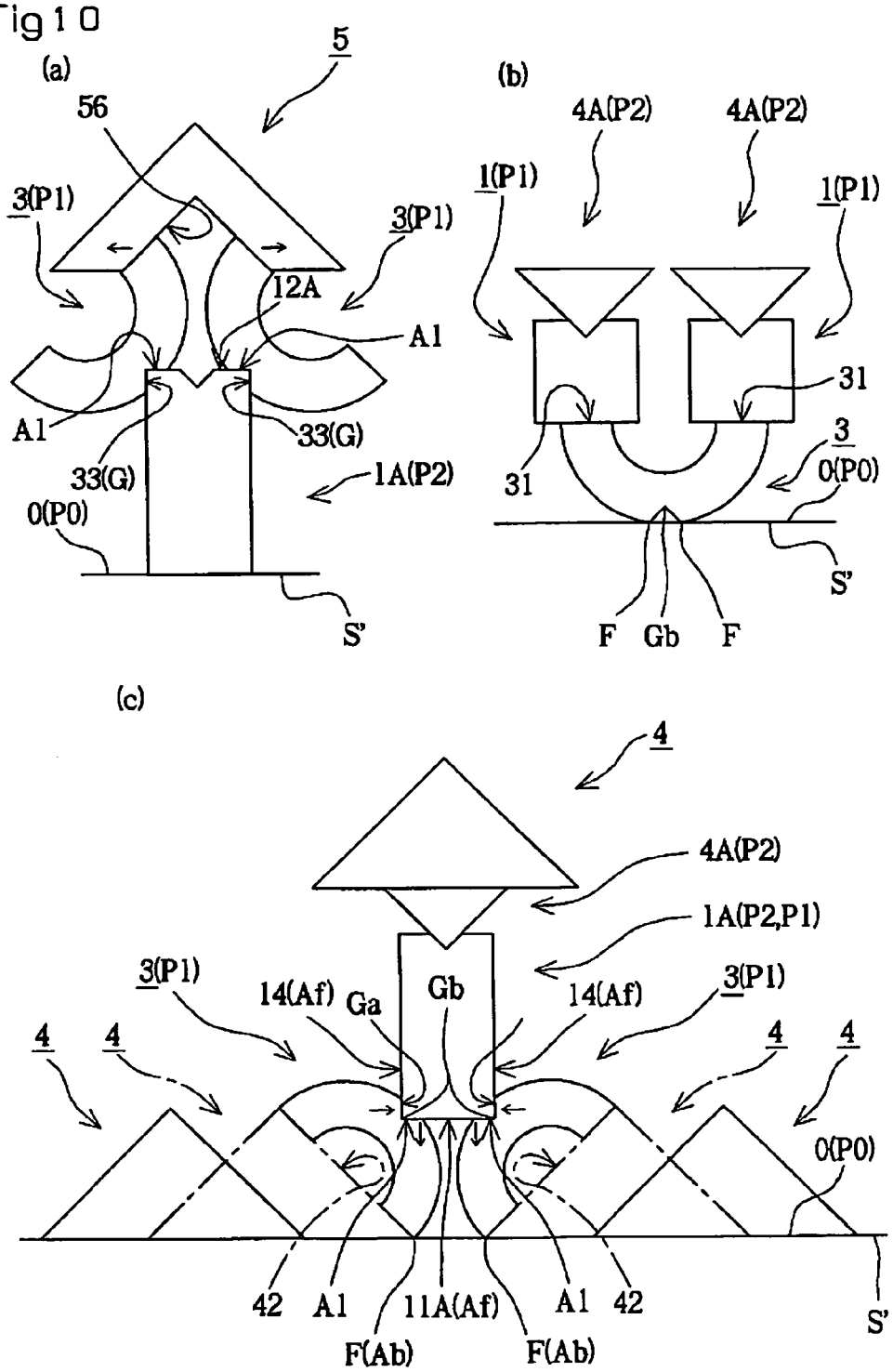
FIG. 10*a* to 10*c* are front view showing further combinations of the blocks.
Figure 1:
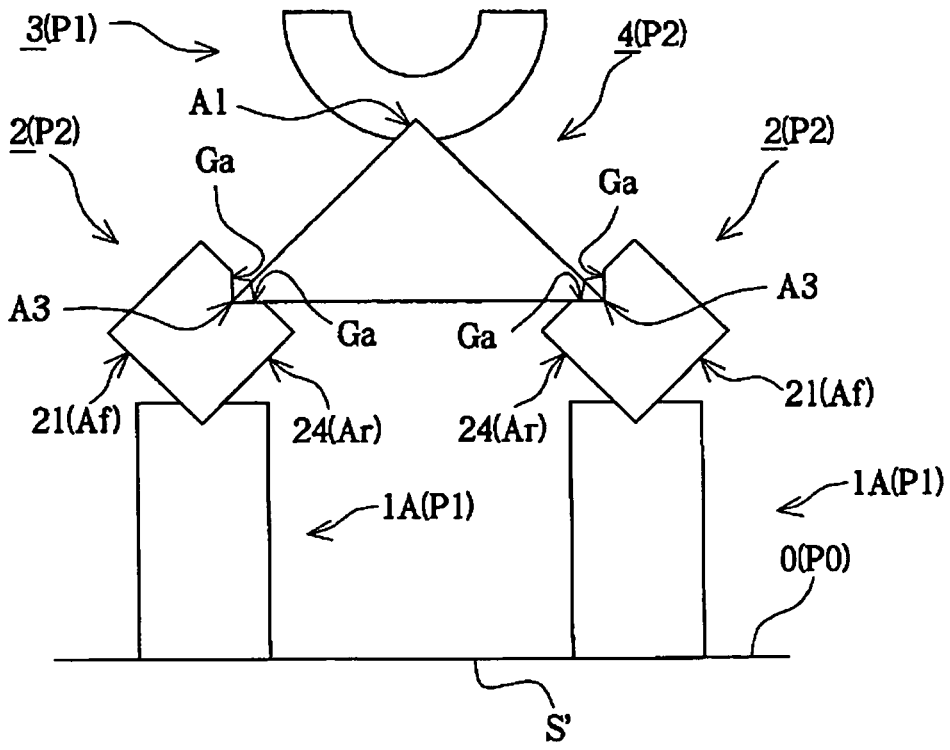

FIG. 8 illustrates an example of the combination where the wide square shaft block 1B is placed on the horizontal plane of a desk or the like and its groove 13B receives at the front half the linear corner edge A1 of the cube block 1 and at the rear half the right-angled corner edge A1 of the triangle block 4. In this combination, the wide square shaft block 1B serves as the first piece P1 while the cube block 1 and the triangle block 4 serve as the second pieces P2.

FIG. 9*a* illustrates another example of the combination where the long square shaft block 1A serves as the first piece P1 and accepts at its groove 13A the linear corner edge A1 of the cube block 1 serving as the second piece P2. While the cube block 1 is tilted at 45 degrees, its linear corner edge A1' coming opposite to the linear corner edge A1 accepted in the groove 13A is the uppermost point. FIG. 9*b* illustrates a modification of the combination shown in FIG. 9*a* where the doughnut half block 3 serving as the first piece P1 is engaged at its groove 33 with the linear corner edge A1' of the cube block 1. FIG. 9*c* illustrates a further example of the combination where the long square shaft block 1A serving as the first piece P1 is engaged at its groove 13A with the linear corner edge A1 of the recessed triangle block 5 serving as the second piece P2 while the recess 56 of the recessed triangle block 5 receives the doughnut block 6, making a balance.

FIG. 9*d* illustrates a further example of the combination starting with two of the recessed triangle blocks 5, 5 joined to each other thus to develop substantially 90 degrees of the corner at each abutment of the triangle corner edges A3, A3 and serve in a pair as the second piece P2. The abutment corner is then received by the groove 33 of the doughnut half block 3 placed on the horizontal plane S7 as serving as the first piece P1. Another doughnut half block 3 is placed over the opposite abutment corner at 90 degrees of the two recessed triangle blocks 5, 5 remaining balanced. At the time, the groove G of each doughnut half block 3 allows the two recessed triangle blocks 5, 5 to be closely held together and joined to each other. The two recessed triangle blocks 5, 5 may be engaged at their linear corner edges A1, A1 with the groove 33 of the doughnut half block 3.

FIG. 10*a* illustrates a still further example of the combination where the long square shaft block 1A serving as the second piece P2 is placed on the horizontal plane S7 and engaged at both the linear corner edges A1, A1 of its top side 12A with the grooves 33, 33 of the two doughnut half blocks 3, 3 respectively serving as the first pieces P1. Then, the recessed triangle block 5 is placed on the two doughnut half block 3 with both the linear corner edges A1, A1 of its top side remaining engaged with the corresponding grooves 33, 33 so that its inner side at its recess 56 comes into face contact with the bottom sides 31, 31 of both the doughnut half blocks 3, 3. Since any stress for disengaging the doughnut half blocks 3, 3 from the corresponding linear corner edges A1, A1 is symmetrically relieved by the inner side at the recess 56 of the recessed triangle block 5, the blocks can be built up with balance.

FIG. 10*b* illustrates a still further example of the combination starting the doughnut half block 3 placed in an inverted form on the horizontal plane S'. More specifically, the doughnut half block 3 is supported on the plane S' at a pair of supporting lines F, each defined between the top side 34 and the groove surface Ga. Two of the cube blocks 1, 1 are placed symmetrically at the left and the right on the bottom side 31 of the doughnut half block 3. Then, two of the small triangle blocks 4A, 4A are placed in the groove engagement on the corresponding cube blocks 1, 1. Since the weight of the cube blocks 1, 1 and the small triangle blocks 4A, 4A is uniformly received by the two supporting lines F, F, the combination f the blocks can be balanced between the right and the left. In this example, the cube blocks 1, 1 serve as the first pieces P1 while the small triangle blocks 4A, 4A serve as the second pieces P2.

FIG. 10*c* illustrates a still further example of the combination where two of the triangle blocks 4, 4 are place on the horizontal plane S' and their sloping sides 42, 42 support the doughnut half blocks 3, 3 respectively serving as the first pieces P1. The long square shaft block 1A serving as the second piece P2 is engaged at both the linear corner edges A1, A1 of its bottom side 11A with the grooves 33, 33 of the two doughnut half blocks 3, 3. Then, the small triangle block 4A serving as the first piece P1 is placed on the long square shaft block 1A and another triangle block 4 is finally placed on the small triangle block 4A. At the time, the two opposite lateral sides 14A, 14A of the long square shaft block 1A along the linear corner edges A1, A1 are parallel with as accepted in the corresponding grooves 33, 33 of the doughnut half blocks 3, 3 while the bottom side 11A extends parallel with the horizontal plane S'. When the two small triangle blocks 4, 4 are removed from the corresponding doughnut half blocks 3, 3, the remaining blocks can securely be held in a building from but not separated from one another. More particularly, the surface Ga at one side of each groove 33 extending parallel with the horizontal plane S' are loaded with the weight of the blocks 1A, 4A, and 4 while the other surface Ga of each groove 33 receives a lateral stress from the doughnut half block 3. As the lateral stresses against the groove surfaces Ga, Ga are urged from both sides, they are offset to make a balance. All the weight is supported along the support line F between the bottom side 31 and the top side 34 of the doughnut half block 3 at either side.

FIG. 11 illustrates a still further example of the combination where two of the long square shaft blocks 1A, 1A are spaced by a distance from each other and engaged with the corresponding cylinder blocks 2, 2 at the upper. At the time, the two corresponding surfaces Ga, Ga of the grooves in the two cylinder blocks 2, 2 are parallel with each other while the other two surfaces Ga, Ga extend parallel with the horizontal plane S'. The two surfaces Ga, Ga of the grooves extending parallel with the horizontal plane S' then support directly the two triangle corner edges A3 of the triangle block 4. The doughnut half block 3 is placed on the linear corner edge A1 of the doughnut half block 3. At the time, the bottom side 21 of each cylinder block 2 having the flat plane Af stays in face contact with the surface Ga of the groove in the corresponding long square shaft block 1A while the lateral side 24 having the circular plane Ar is in linear contact with the other surface Ga of the same. As the weight of the upper blocks is equally received by the two supporting blocks at the left and the right, the blocks can be balanced and built up to develop a desired bcorner edge form. The two long square shaft blocks 1A, 1A and the doughnut half blocks 3 serve as the first pieces P1 while the cylinder blocks 2, 2 and the triangle block 4 serve as the second pieces P2.

Finally, other feasible embodiments of the present invention will be described.

The unit dimension described in the foregoing embodiment of the building blocks is not limited to 35 mm or 70 mm but may arbitrarily be determined as desired. More specifically, 35 mm is the unit dimension while 70 mm is two times the unit dimension in the embodiment. The blocks may be fabricated from any other applicable material than wood, such as plastic resin, cork, or sponge, which can provide a favorable degree of physical strength particularly at the grooves.

In the foregoing embodiment, the blocks are classified into two types, the first piece P1 and the second piece P2. The combination between the first piece P1 and the second piece P2 having at least one corner edge is not limitative but may be implemented by any other modification with balance. It is at least conditioned that the engagement between a groove and a corner edge is involved while the pattern of building form is indefinite.

Figure 15:
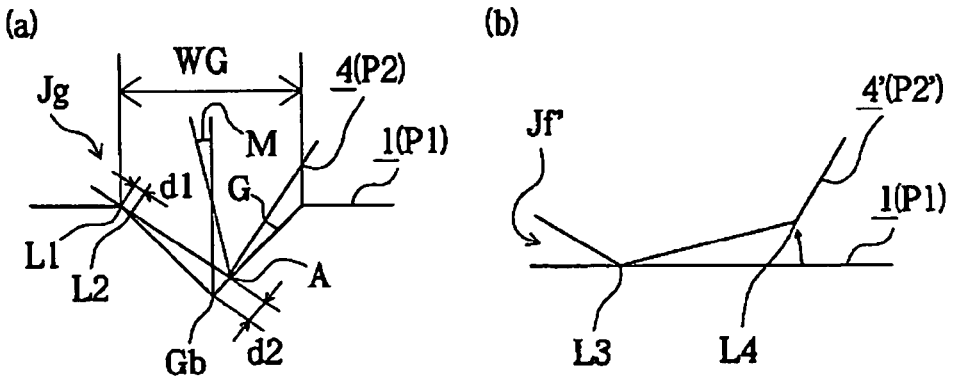
FIGS. 15*a* and 15*b* are an enlarged front view of a primary part showing a positional relationship between the groove and the corner when displaced and an enlarged front view of a primary part showing a combination of the blocks having no grooves respectively.
Figure 16:
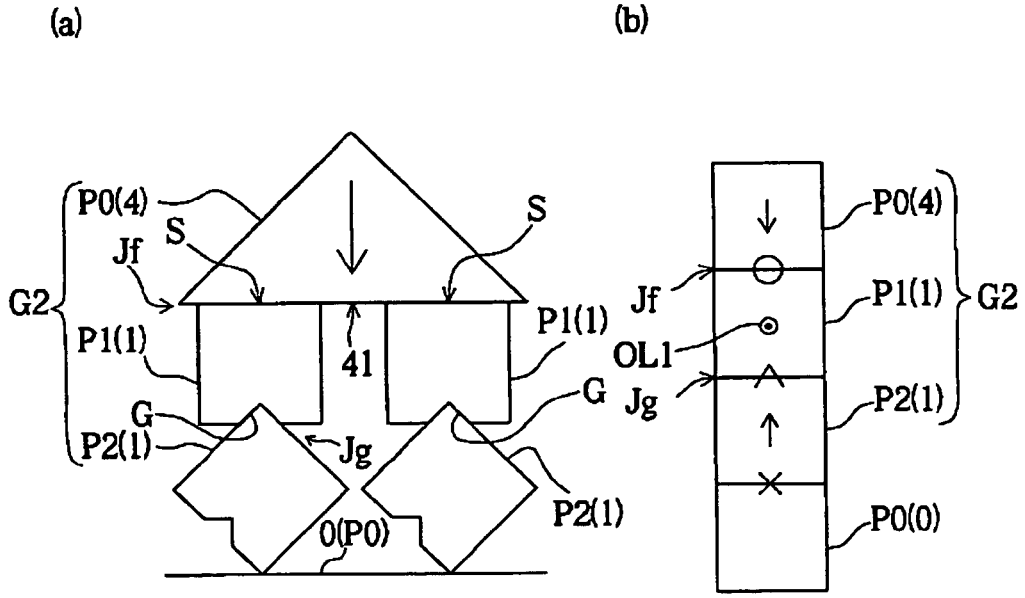
FIGS. 16*a* and 16*b* are a front view showing a combination of the blocks with the flat sides positioned upper than the grooved sides and a functional model diagram of the combination shown in FIG. 16*a;*
Figure 17:
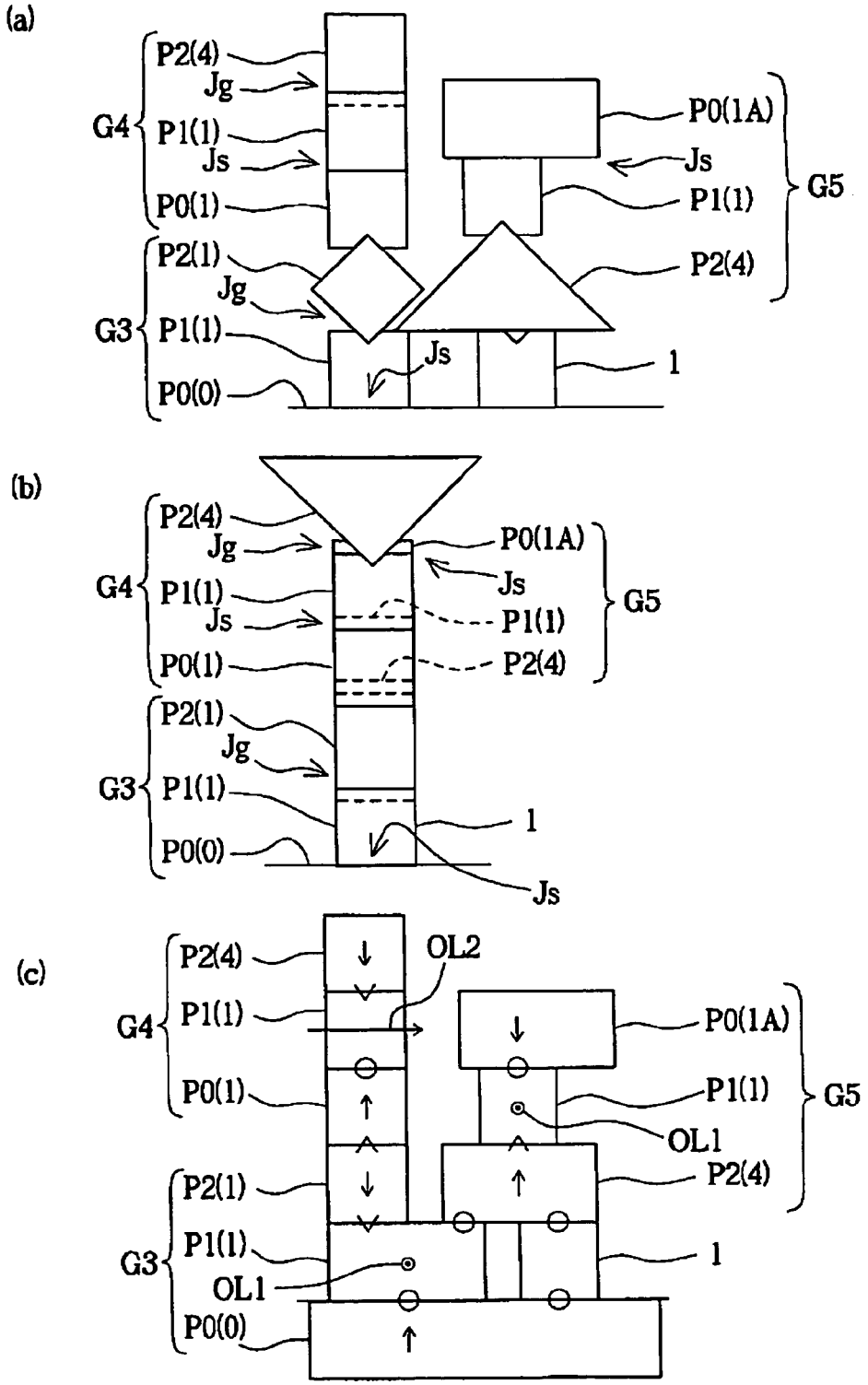
FIGS. 17*a*, 17*b*, and 17*c* are a front view showing a more intricate combination of the blocks, a side view of the same, and a functional model diagram of the combination shown in FIG. 17*a* respectively.

Also, the foregoing embodiment defines that the depth of the groove is 6 mm and the width WG of the groove is ⅓ the unit dimension. The depth of the groove is not limited to 6 mm. The blocks in a building form may be balanced with ease when the width (or depth) of the groove is greater or with difficulty when the same is smaller. The size can be determined depending on the use and purpose under the principle shown in FIG. 15*a*.

For ease of the description of the foregoing embodiment, the building blocks are assembled in such a combination as shown in FIG. 12. The combination is not limited to that shown in FIG. 12. The first piece P1 and the second piece P2 may arbitrarily be determined in the number and type. For example, the second piece P2 with no groove may be implemented by a block which is arranged identical in the shape to the cube block 1 but having no groove.

In the foregoing embodiment, the ratio between two dimensions for the blocks is 1:2 as bound by the definition. The ratio may be 1:3 or any combination of integral numerals if desired. The ratio of 1:0.5 may also be feasible.

Although the shape at the groove bottom Gb and the corner edge line Ab is arranged at substantially a right angle in the foregoing embodiment, it may be rounded so long as the engagement between the groove and the corner edge remains favorable.

The alphabets and numerals used in the appended claims are applied for ease of the description referring to the drawings and shall not bind the arrangement shown in the drawings of the present invention.

Industrial Applicability

The building blocks according to the present invention is favorably used as a children's playing toy and applicable to any action for preventing from senile dementia or rehabilitating the fingers of a disabled person. Also, the building blocks can freely be assembled to build up a decorative object.

What is claimed is:

1. A set of building blocks comprising:

a first piece (P1) having a flat plane (S), a top side (34) and a bottom side, wherein, at a center of the top side (34), a V-shaped groove (G) whose two surfaces (Ga, Ga) are tilted symmetrically from a reference plane (H) orthogonal to the flat plane (S) or a plane (S') including the flat plane (S), an angle formed by each of the two surfaces (Ga, Ga) and the reference plane (H) being approximately 45 degrees, and whose bottom (Gb) extends parallel with the flat plane (S) is formed, wherein the first piece (P1) is in a doughnut half shape, the V-shaped groove extends in an axis direction of the doughnut half in the uppermost of a top side (34) thereof, and a recess (36) of a semi-circular column shape is formed at a center in a width direction of the bottom side of the first piece (P1) in the axis direction of the doughnut half; and a second piece (P2) having at least a corner edge (A) to be engaged with the groove (G) of the first piece (P1), so that one side (Af) of the corner edge is brought substantially in face contact with the V-shaped groove (G), wherein a first width (WS) of the flat plane (S) is greater than a second width (WG) of the groove (G) along the direction perpendicular to the reference plane (H), and a center of the first width (WS) of the flat plane(S) is coincided with a center of the second width (WG) of the groove (G).

2. A set of building blocks comprising:

a first piece (P1) which includes a flat face (S) and a top side face paralleled to the flat face (S), wherein, at a center of the top side face, a V-shaped groove (G) whose two surfaces (Ga, Ga) are tilted symmetrically from a reference face (H) orthogonal to the flat face (S) or a face (S') including the flat face (S), an angle formed by each of the two surfaces (Ga, Ga) and the reference face (H) being approximately 45 degrees, and whose bottom (Gb) extends parallel with the flat face (S), is formed;

a second piece (P2) having at least a corner edge (A) to be engaged with the groove (G) of the first piece (P1), so that one side face (Af) of the corner edge is brought substantially in face contact with the groove (G), wherein a first width (WS) of the flat face (S) is greater than a second width (WG) of the groove (G) along the direction perpendicular to the reference plane (H), and a center of the first width (WS) of the flat face (S) is coincided with a center of the second width (WG) of the groove (G); and wherein the first piece (P1) has a portion capable of supporting a third piece thereon.

3. A set of building blocks comprising:

a first piece (P1) having a flat face (S) and a V-shaped groove (G) whose two surfaces (Ga, Ga) are tilted symmetrically from a reference plane (H) orthogonal to the flat face (S) or a face (S') including the flat face (S), an angle formed by each of the two surfaces (Ga, Ga) and the reference plane (H) being approximatelty 45 degrees, and whose bottom (Gb) extends parallel with the flat face (S); and a cylindrical second piece (P2), having at least a corner dege (A) to be engaged with the groove (G) of the first piece (P1), one side face of the corner edge (A) being a top side face or a bottom side face of the cylindrical second piece and the other side face of the corner dege is a side face of the cylindrical second piece (P2), so that one of the two surfaces (Ga, Ga) of the V-shaped groove (G) is brought substantially in face contact with the top side or the bottom side, and the other one of the two surfaces (Ga, Ga) of the V-shape groove (G) and the other side of the corner edge (A) are brought in line contact with each other, wherein a first width (WS) of the flat face (S) is greater than a second width (WG) of the groove (G) along the direction perpendicular to the reference plane (H), and a center of the first width (WS) of the flat face (S) is coincided with a center of the second width (WG) of the groove (G).

4. A set of building blocks according to claim 3, wherein the first piece (P1) is arranged of a semi-circular cylindrical shape having the groove (G) provided axially in an uppermost of the top side (34) thereof and the recess (36) of a semi-circular column shape provided axially in a widthwise center of the bottom side thereof.

5. A set of building blocks according to claim 2, or 3, wherein while a pair of the first pieces are used, the second piece (P2) is arranged in that one side (Af) at one of the two corner edges (A) of the second piece (P2) extends parallel with one side (Af) at the other of the two corner edges (A) and both the one sides are located at a same side of the second piece (P2) so that each flat face (S) of the first piece is tilted at 45 degrees to the horizontal face (S') to engage the corner edge (A) with the corresponding groove (G).

6. A set of building blocks according to claim 5, wherein the first piece (P1) of which the flat face (S) tilted at 45 degrees is supported by a triangle block (4) which has 45-degree corner edges and can be removed when a combination of the building blocks have been built up.

7. A set of building blocks according to claim 2 or 3, wherein while a pair of the first pieces are used, the second piece (P2) is arranged in that one side (Af) at one of the two corner edges (A) of the second piece (P2) extends parallel with one side (Af) at the other of the two corner edges (A) and both the one sides are located at the same side of the second piece (P2) so that the two corner edges (A) of the second piece is engaged with the corresponding groove (G) in the first piece to make a face contact between the recess (56) of a recessed triangle block (5) and the bottom side (31) of the first piece (P1).

8. A set of building blocks according to claim 2 or 3, wherein the second piece (P2) cosists of two blocks which have substantially a right angle developed by jointing two corner edges (A3) of substantially 45 degrees so that the two joined corner edges (A3) at either upper or lower side can be engaged with the groove (G) in each the first piece (P1).

9. A set of building blocks according to claim 2 or 3, wherein a pair of cube blocks serving as the second pieces (P2) are placed in their 45 degrees tilted form on a horizontal face (S'), the first piece (P1) is fitted on the corner edge (A) of each cube block, and another block is placed on the flat faces (S) of the two first pieces (P1).

10. A set of building blocks according to claim 2, wherein both sides (Af, Af) at the corner edge (A) are arranged to come substantially in face contact with the groove (G).

11. A set of building blocks according to claim 2, wherein other side (Ar) at the corner edge (A) is arranged of a cylindrical face to come substantially in linear contact with the groove (G).

12. A set of building blocks according to claim 2 or 3, wherein ridge line (Ab) along the corner edge (A) at each end of the flat face (S) extends parallel with a lengthwise bottom (Gb) of the groove (G).

13. A set of building blocks according to claim 2 or 3, wherein the second piece (P2) has the flat face (S) and the groove (G).

14. A set of building blocks according to claim 2 or 3, wherein the first piece (P1) is arranged of fundamentally a cubic shape, a rectangular parallelepiped shape, and/or a cylindrical shape.

15. A set of building blocks according to claim 2, wherein the second piece (P2) is arranged of fundamentally a right-angle isosceles shape.

* * * * *